US012383111B2

(12) United States Patent
Mi et al.

(10) Patent No.: US 12,383,111 B2
(45) Date of Patent: Aug. 12, 2025

(54) SIDE BRUSH AND INTELLIGENT CLEANING DEVICE

(71) Applicant: Beijing Roborock Technology Co., Ltd., Beijing (CN)

(72) Inventors: Chang Mi, Beijing (CN); Chuanlin Duan, Beijing (CN)

(73) Assignee: Beijing Roborock Technology Co., Ltd., Beijing (CN)

( * ) Notice: Subject to any disclaimer, the term of this patent is extended or adjusted under 35 U.S.C. 154(b) by 1021 days.

(21) Appl. No.: 17/230,034

(22) Filed: Apr. 14, 2021

(65) Prior Publication Data

US 2021/0228048 A1 Jul. 29, 2021

Related U.S. Application Data

(63) Continuation of application No. PCT/CN2019/082691, filed on Apr. 15, 2019.

(30) Foreign Application Priority Data

Oct. 15, 2018 (CN) ..... 201821672719.X

(51) Int. Cl.
*A47L 11/40* (2006.01)
*A46B 1/00* (2006.01)
(Continued)

(52) U.S. Cl.
CPC ..... *A47L 11/4036* (2013.01); *A46B 1/00* (2013.01); *A46B 5/0066* (2013.01); *A46B 5/06* (2013.01); *A46B 13/00* (2013.01); *A47L 11/24* (2013.01); *A47L 11/282* (2013.01); *A46B 2200/30* (2013.01)

(58) Field of Classification Search
CPC ..... A47L 11/16; A47L 11/162; A47L 11/164; A47L 11/206; A47L 11/4036; A47L 11/4038; A47L 11/4044; A47L 9/005; A47L 9/066; A47L 9/0666; A47L 11/2025; A47L 11/2065; A47L 11/282;
(Continued)

(56) References Cited

U.S. PATENT DOCUMENTS

2016/0128535 A1 5/2016 Larson

FOREIGN PATENT DOCUMENTS

CN 2008-188221 A 8/2008
CN 102834036 A 12/2012
(Continued)

OTHER PUBLICATIONS

International Search Report issued in related International Patent Application No. PCT/CN2019/082691 dated Jun. 19, 2019.
(Continued)

*Primary Examiner* — Eric J Rosen
*Assistant Examiner* — Aaron R McConnell
(74) *Attorney, Agent, or Firm* — Morgan, Lewis & Bockius LLP

(57) ABSTRACT

This application discloses a side brush and a smart cleaning device. The side brush includes a side brush base for mounting to a smart cleaning device and a scraper connected to a peripheral side of the side brush base. The scraper is configured to be in contact with the floor, so as to scrape sundries. A structure of the side brush can effectively prevent the side brush from being entangled with sundries during cleaning.

14 Claims, 6 Drawing Sheets

(51) Int. Cl.

| | |
|---|---|
| ***A46B 5/00*** | (2006.01) |
| ***A46B 5/06*** | (2006.01) |
| ***A46B 13/00*** | (2006.01) |
| ***A47L 11/24*** | (2006.01) |
| ***A47L 11/282*** | (2006.01) |

(58) Field of Classification Search
CPC .... A47L 11/283; A47L 11/293; A47L 11/305; A46B 9/005; A46B 13/008; B60S 1/28
USPC ..... 15/93.1, 111
See application file for complete search history.

(56) References Cited

FOREIGN PATENT DOCUMENTS

| | | | | | |
|---|---|---|---|---|---|
| CN | 103549920 | A | | 2/2014 | |
| CN | 205697568 | U | | 11/2016 | |
| CN | 205903223 | U | | 1/2017 | |
| CN | 106913288 | A | | 7/2017 | |
| CN | 107184288 | A | * | 9/2017 | ..... A46B 15/0055 |
| CN | 107890325 | A | | 4/2018 | |
| EP | 2270619 | A2 | | 1/2011 | |
| EP | 2270620 | A2 | | 1/2011 | |
| JP | 2014236956 | A | * | 12/2014 | |
| TW | 201605396 | A | * | 2/2016 | |

OTHER PUBLICATIONS

Extended European Search Report issued in related European Patent Application No. 19872969.1 dated Jul. 1, 2022.

* cited by examiner

SIDE BRUSH AND INTELLIGENT CLEANING DEVICE

CROSS-REFERENCE TO RELATED APPLICATIONS

The present application is a continuation application of International Application No. PCT/CN2019/082691, filed on Apr. 15, 2019, which claims priority to Chinese Patent Application No. 201821672719. X, filed on Oct. 15, 2018, both of which are incorporated herein by reference in their entireties for all purposes.

TECHNICAL FIELD

The present application relates to the field of cleaning tool technologies and, more specifically, to a side brush and a smart cleaning device.

BACKGROUND

Existing smart cleaning devices such as smart cleaning machines are usually provided with side brushes at their bottoms. The side brushes are able to rotate to move debris on a floor surface to the cleaning region under the smart cleaning device.

SUMMARY

According to an aspect, this application provides a side brush, including a side brush base for mounting to a smart cleaning device, and a scraper connected to a peripheral side of the side brush base, where the scraper is configured to engage the floor, so as to scrape sundries.

According to another aspect, the embodiments of the present application provide a smart cleaning device, including a device body and the foregoing side brush.

BRIEF DESCRIPTION OF DRAWINGS

The following accompanying drawings of the embodiments of the present application are used herein as a part of the present application for understanding of this application. The accompanying drawings show embodiments of the present application and descriptions of the embodiments, which are used to explain apparatuses and principles of the present application. In the drawings.

DESCRIPTION OF EMBODIMENTS

Figure 1:
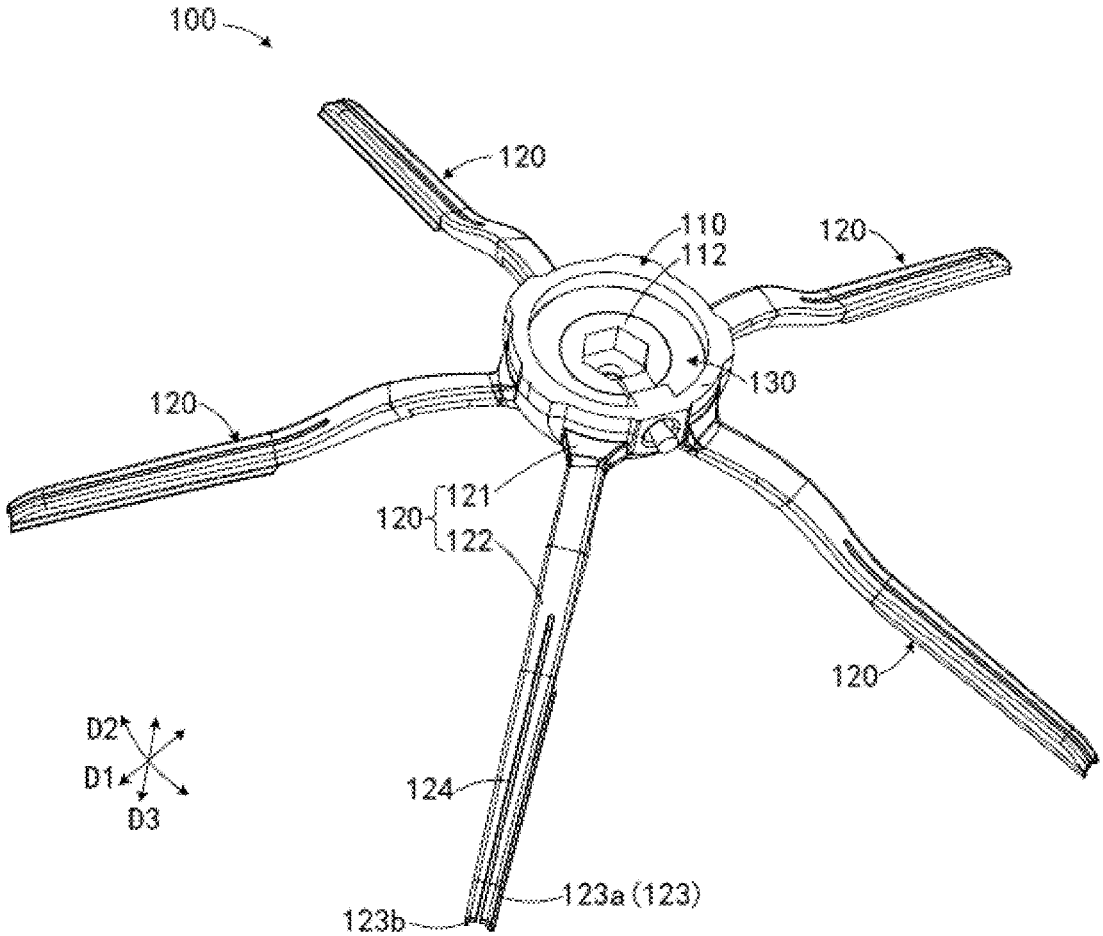
FIG. 1 is a schematic three-dimensional diagram of a side brush according to an optional embodiment of the present application.

The following describes specific details to provide a more thorough understanding of the present application. However, it is obvious to a person skilled in the art that the present application can be implemented without one or more of these details. In other examples, to avoid confusion with the present application, some technical features well known in the art are not described.

To fully understand the present application, the following description provides a detailed structure to illustrate the present application. Clearly, the implementation of the present application is not limited to the specific details well known to a person skilled in the art. The following describes example embodiments of the present application in detail. However, in addition to these detailed descriptions, the present application can have other embodiments, and should not be construed as being limited to the embodiments provided herein.

It should be understood that the terms used herein are merely intended to describe specific embodiments, and are not intended to limit the present application. The singular forms of "a/an" and "one" are also intended to include plural forms, unless the context clearly indicates another manner. The terms "include" and/or "comprise" used in the specification specify the existence of the features, entireties, steps, operations, elements and/or components, but do not exclude the existence or addition of one or more other features, entireties, steps, operations, elements, components, and/or a combination thereof. The terms "upper," "lower," "front," "rear," "left," "right" and similar expressions used in the present application are merely intended for illustrative purposes and are not intended to impose a limitation.

The ordinal numbers such as "first" and "second" cited in the present application are merely identifiers and do not have any other meaning, such as a particular order. In addition, for example, the term "first component" does not imply the existence of a "second component" and the term "second component" does not imply the existence of a "first component."

The following describes in more detail the specific embodiments of the present application with reference to the accompanying drawings. These accompanying drawings illustrate representative embodiments of the present application and are not intended to limit the present application.

Generally, a smart cleaning device mainly includes a device body. The device body can be in an approximate circular shape (both the front and the back are circular) or can be in other shapes. It can be understood that the smart cleaning device shown in the present application may be a sweeping robot, a mopping robot, a sweeping and mopping robot, or the like.

The smart cleaning device includes a cleaning system, a perception system, a control system, a driving system, an energy system, a man-machine interaction system, and the like. Various systems cooperate with each other to make the smart cleaning device autonomously move and implement a cleaning task. Functional elements and the like that constitute the above-mentioned systems in the smart cleaning device are integrated into the device body. The device body includes an upper cover, a chassis, and a middle frame disposed between the upper cover and the chassis. The middle frame serves as a basic frame for disposing various functional elements. The upper cover and the chassis cover a surface of the device body to protect internal parts and improve appearance of the smart cleaning device.

Autonomous movement of the smart cleaning system is implemented by the driving system. The driving system mainly includes a traveling wheel, a driving motor, and a control circuit for controlling the driving motor. To enable the smart cleaning device to move more stably on the floor or to have a stronger motion ability, the smart cleaning device may include one or more driven wheels, and a driven wheel includes but is not limited to a caster.

The perception system is used by the smart cleaning device to perceive an external environment such as topography. The perception system includes sensing apparatuses such as a position determining apparatus, a bumper, a cliff sensor, an ultrasonic sensor, an infrared sensor, a magnetometer, an accelerometer, a gyroscope, and an odometer. These sensing apparatuses provide various position information and motion state information of the smart cleaning device for the control system. The position determining apparatus includes but is not limited to an infrared emitter and receiver, a camera, and a laser ranging apparatus (laser distance sensor or LDS). The bumper is configured to relieve a collision between the smart cleaning device and an object during movement. A layer of flexible material is provided on a surface of the bumper, the bumper is mounted to the device body, and the predetermined distance between the bumper and the device body can ensure sufficient time for the device body to decelerate in case of a collision.

The control system is provided on the main circuit board in the device body and includes a nontransient memory, a computing processor, and the like. The computing processor may be a central processing unit, an application processor, or the like. The computing processor generates, based on obstacle information provided by the laser ranging apparatus and a positioning algorithm, an instant map of an environment in which the smart cleaning device is located. Based on the distance information and speed information provided by the bumper and the sensing apparatuses, the control system may determine a current working status of the smart cleaning device, such as crossing a threshold, crossing an edge of a carpet, reaching a cliff, getting stuck, having a full dust box, or being picked up. In addition, the control system provides next actions, based on different situations, to make the performance of the smart cleaning device meet a certain requirement and improve user experience.

The man-machine interaction system includes buttons on a panel of the robot, which are employed for a user to select functions. The man-machine interaction system may further include a display screen, an indicator, and/or a speaker, which provide the current status of the machine or function options for the user. The man-machine interaction system may further include a mobile phone application. For a route-navigated smart cleaning device, the mobile phone application can show a map of the environment in which the device is located, as well as the location of the smart cleaning device, to the user, thereby providing the user with abundant and user-friendly function options.

The energy system is configured to supply power to the elements of various systems, and mainly includes a rechargeable battery and a power supply circuit. The rechargeable battery can be an NiMH battery or a lithium battery. When power of the rechargeable battery is less than a predetermined threshold, the rechargeable battery may be charged by contacting a charging device and a charging electrode disposed on a side or the bottom of the device body.

The cleaning system is an important system of the smart cleaning device and is configured to implement a cleaning function. The cleaning system includes a dry-cleaning assembly and a wet-cleaning assembly. The dry-cleaning assembly mainly removes loose particulates from a to-be-cleaned surface by using a cleaning brush and the like. The wet-cleaning assembly mainly mops the to-be-cleaned surface (such as a floor surface) by using a cleaning cloth saturated with cleaning liquid.

The dry-cleaning unit may mainly include a rolling brush, a waste container, and a vacuum. The vacuum is connected to the waste container through an air duct and configured to generate suction force. Specifically, as the smart-cleaning device moves, the rolling brush comes in contact with the floor surface, the debris on the floor surface is agitated and taken to a suction door between the rolling brush and the waste container, and then sucked into the waste container by the suction force generated by the vacuum.

The wet-cleaning assembly may mainly include a liquid reservoir and a cleaning cloth. The liquid reservoir may be configured to contain cleaning liquid, and the detachable cleaning cloth is disposed on the liquid reservoir. After the dry-cleaning unit completes cleaning, the liquid in the liquid reservoir flows to the cleaning cloth, and the cleaning cloth mops the floor surface cleaned by the rolling brush and the like.

The dry-cleaning unit may further include a side brush. The side brush is disposed on the device body with a rotation shaft. Specifically, the side brush may be mounted at the edge of the bottom of the device body. The side brush may rotate about the rotation shaft, so as to move the debris into a cleaning region of the rolling brush.

To resolve the problem of a bristle brush being easily entangled with debris, the embodiments of the present application provide a side brush. The side brush is provided with a scraper 123, which is configured to rotate to remove debris. The movement of the scraper 123 mainly includes two types: traveling movement, which enables the smart cleaning device and the scraper 123 to reach a specified location; and rotation movement about a rotation shaft. The following provides descriptions with reference to the accompanying drawings.

Figure 2:
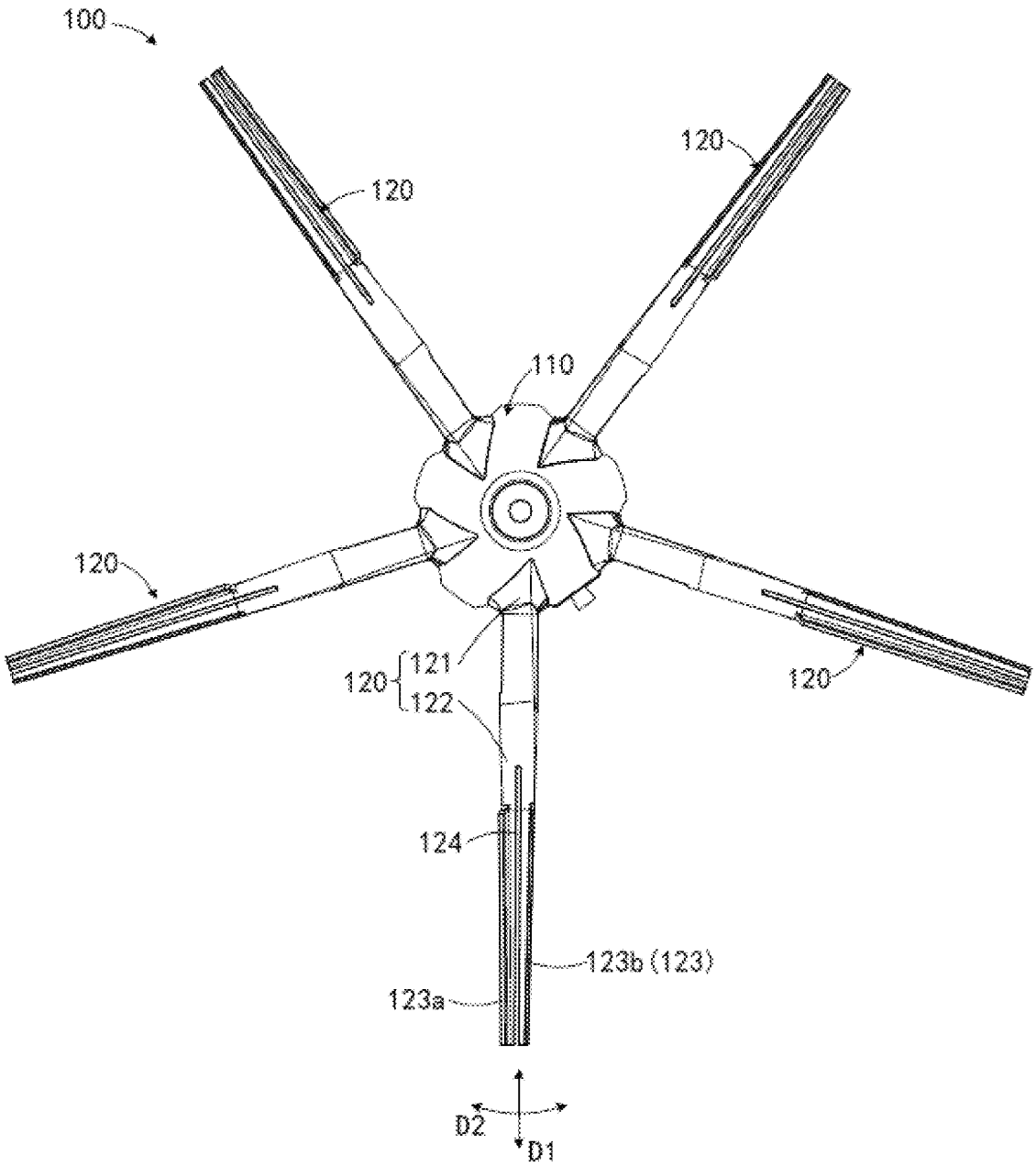
FIG. 2 is a schematic bottom view of a side brush shown in FIG. 1.
Figure 3:
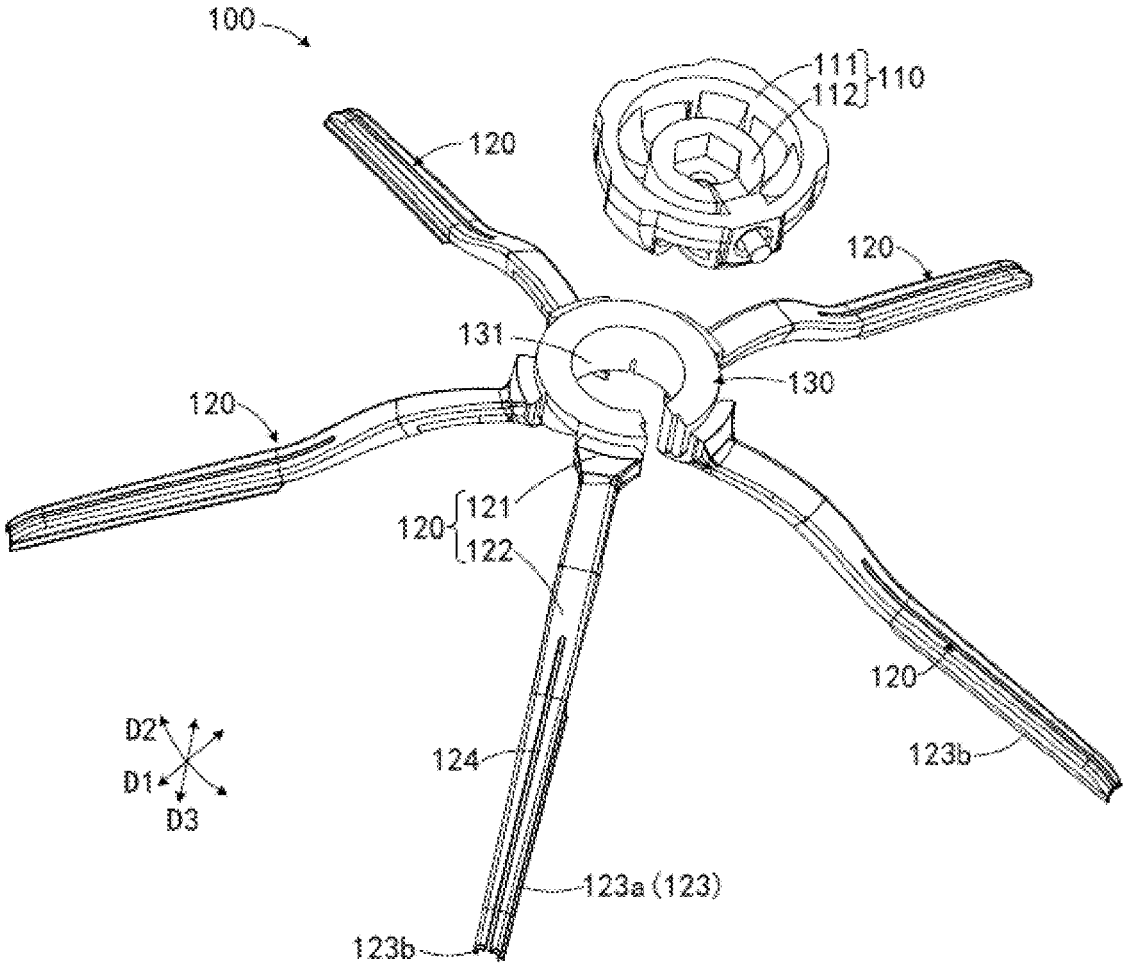
FIG. 3 is an exploded schematic three-dimensional diagram of the side brush shown in FIG. 1.

As shown in FIG. 1 to FIG. 3, a side brush 100 includes a side brush base 110 and a brush body 120. The side brush base 110 is mounted to the device body of the smart cleaning device. The brush body 120 extends outward from the side brush base 110 in a radial direction D1. At least one brush body 120 may be provided. In an embodiment, there are at least two brush bodies 120, the brush bodies 120 may extend in a radial direction, and they may be approximately evenly distributed around the side brush base 10.

It should be noted that the direction terms such as "downward," "faces upward," and "upward" that are used to describe the side brush 100 in this specification are relative to a horizontal mounting status of the side brush 100. It can be understood that "radial direction D1" is a radial direction D1 relative to a rotation shaft of the side brush 100, "circumferential direction D2" is a circumferential direction D2 relative to the rotation shaft of the side brush 100, and "axial direction D3" is a direction extending along the rotation shaft. "Outward from the side brush base 110" refers to a direction that is away from the side brush base 110. Further, for example, "downward" refers to a direction in which the axial direction D3 extends toward a free end of the brush body 120; and "upward" refers to a direction in which the axial direction D3 extends toward the side brush base 110.

The brush body 120 includes a brush body mounting part 121 and a brush body extension part 122. The brush body mounting part 121 is configured to connect to the side brush base 110. The brush body extension part 122 extends outward in the radial direction D1 from the brush body mounting part 121 to clean debris. The brush body mounting part 121 and the brush body extension part 122 may be integrally formed. Or the brush body extension part 122 may be assembled into the brush body mounting part 121 by buckling or clamping. In an embodiment, the side brush 100 may be effectively prevented from being entangled with debris such as hair during cleaning, thereby improving the cleaning effect and ensuring cleaning operation. Optionally, the brush body 120 may be formed through glue material injection molding, so that the brush body extension part 122 may have a property of flexibility, which plays a role in buffering. Therefore, while cleaning, the brush body extension part 122 can efficiently clean debris, thereby implementing high dust pickup efficiency of the smart cleaning device.

In the illustrated embodiments, the brush body extension part 122 is connected to the brush body mounting part 121, and the present application is not limited thereto. In another embodiment, the brush body extension part 122 may be directly connected to a brush body base 130, and, in this case, the brush body mounting part 121 may be omitted.

The side brush 100 further includes the brush body base 130 that couples to the side brush base 110. The brush body mounting part 121 may be connected to the side brush base 110 through the brush body base 130. Referring to FIG. 3, the brush body base 130 and the brush body 120 may be integrally formed. Specifically, the brush body 120 may be connected to the brush body base 130, or the radial brush body and the brush body base 130 may be formed as an integral part. The integral part and the side brush base 110 may be separate members. In another embodiment, the brush body base 130 and the side brush base 110 may be integrally formed. The side brush 100 and the side brush base 110 may be integrally formed, or the side brush 100 can be assembled into the side brush base 110. The brush body base 130 may be made of a plastic material. Therefore, the side brush 100 can closely couple to the rotation shaft for mounting.

Figure 5:
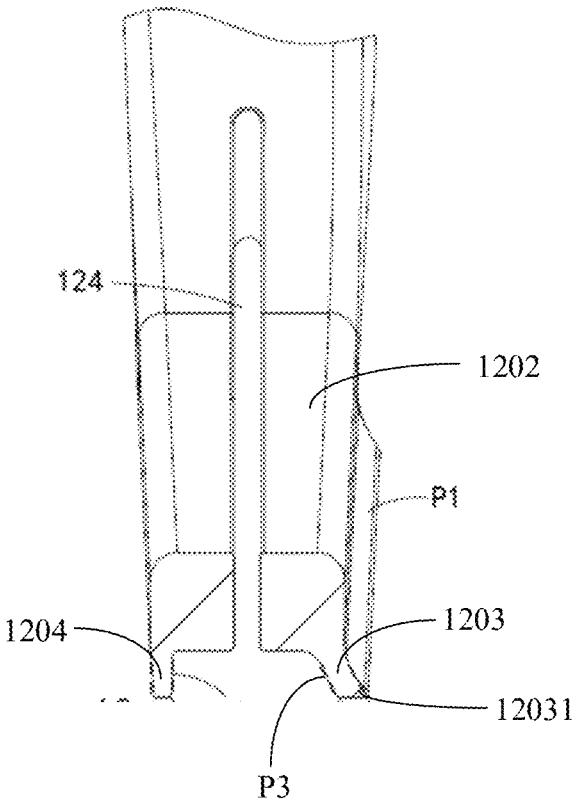
FIG. 5 is a schematic cross-sectional diagram of a brush body shown in FIG. 1.

The brush body 120 may have at least one scraper 123. As shown in FIG. 5, the scraper 123 includes a connecting part 1202 connected to the brush body mounting part 121, and a scraping part 1203 extending from the connecting part 1202 to the floor surface. The scraping part 1203 is in contact with the floor surface to scrape debris, which increases the surface of the scraper 123 that comes in contact with debris and improves cleaning performance. During the cleaning process, the scraper 123 moves the debris to the cleaning region under the smart cleaning device. In an embodiment, there are at least two scrapers 123; the scrapers 123 clean the debris in the rotational direction of the side brush 100 sequentially. The front scraper 123 cleans the debris first, and the debris that are not initially removed are further cleaned by the rear scraper 123, thereby improving the cleaning efficiency and cleaning effect.

In the illustrated embodiments, the scraper 123 includes a scraping part 1203 extending from the connecting part 1202 to the floor surface. During the performance of a cleaning task, the scraping part 1203 comes in contact with the floor surface to remove debris. In another embodiment, the connecting part 1202 can serve as a scraping part, and the connecting part 1202 comes in contact with the floor to remove debris. The scraping part extending to the floor surface may be omitted, which makes the structure simpler.

In an embodiment, the scraper 123 and the brush body extension part 122 are integrally formed, so that the brush body 120 may be formed as an integrally formed member. In another embodiment, the scraper 123 may be coupled to the brush body mounting part 121 by buckling or clamping.

Figure 4:
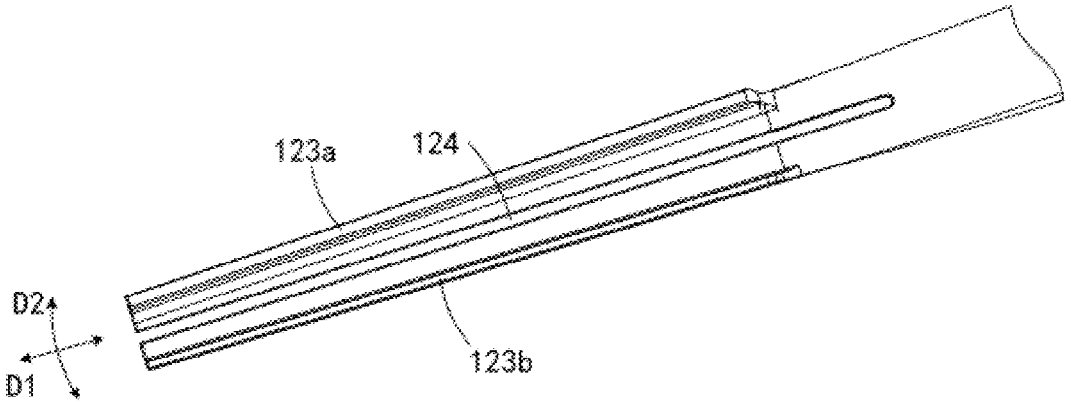
FIG. 4 is a partially enlarged diagram of a brush body shown in FIG. 1.

Further, with combined reference to FIG. 2 and FIG. 4, in an embodiment there are at least two scrapers 123, and the brush body extension part 122 may be provided with an opening 124 that extends in a radial direction D1 and penetrates the free end of the brush body 120. That is, the free brush body extension part 122 is separated by the opening 124. The opening 124 may be disposed between at least two adjacent scrapers 123. The opening 124 extends in the radial direction D1 from the middle of the brush body extension part 122 and penetrates the free end of the brush body 120. In an embodiment, the scrapers 123 do not interfere with each other during cleaning, and elasticity of the scrapers 123 increases. Optionally, the size of the opening 124 in the radial direction D1 can be greater than or equal to the size of the scraper 123 in the radial direction D1.

With combined reference to FIG. 2 and FIG. 5, the opening 124 completely separates the connecting parts 1202 of adjacent scrapers 123, and the present application is not limited thereto. In another embodiment, the opening 124 can partially separate the connecting parts 1202 of adjacent scrapers 123. In the illustrated embodiment, the brush body 120 is provided with the opening 124 to separate the connecting parts 1202 of the front scraper 123*a* and the rear scraper 123*b*. The present application is not limited thereto. In another embodiment, the opening may be omitted, and the connecting parts 1202 of the front scraper 123*a* and the rear scraper 123*b* are connected to each other, that is, the scraper 123 includes the connecting part 1202, and the secondary scraping part 1204 and the scraping part 1203 that are formed through extension downward from two opposite sides of the connecting part 1202.

In the illustrated embodiments, the brush body 120 includes two scrapers 123, which are defined as the front scraper 123*a* and the rear scraper 123*b* in this specification. In the rotational direction of the side brush 100, the front scraper 123*a* is located in front of the rear scraper 123*b*. During the operation of the side brush 100, the front scraper 123*a* is first in contact with debris. The front scraper 123*a* first removes the sundries, and the sundries that are not removed by the front scraper 123*a* may be further removed by the rear scraper 123*b*, thereby improving cleaning efficiency. Specifically, the brush body extension part 122 is a plate-like part extending in the circumferential direction D2. In the illustrated embodiments, the brush body extension part 122 gradually becomes narrower in the radial direction D1. The brush body extension part 122 is provided with the opening 124 between the front scraper 123*a* and the rear scraper 123*b*. The opening 124 separates a portion of the brush body extension part 122 near the free end into two smaller portions. The front scraper 123*a* and the rear scraper 123*b* are close to the edge of the brush body extension part 122 in the axial direction D1, so that there is a specific distance between the front scraper 123*a* and the rear scraper 123*b*.

As shown in FIG. 5, the connecting part 1202 can be coupled to the brush body extension part 122, or the connecting part 1202 and the brush body extension part 122 can be integrally formed. The connecting part 1202 may be directly connected to the brush body base 130, in which case the brush body mounting part 121 is omitted.

The rear scraper 123*b* includes a secondary scraping part 1204. In the rotational direction of the side brush 100, the secondary scraping part 1204 is located on a rear side of the scraping part 1203. The opening 124 separates the scraping part 1203 from the secondary scraping part 1204 completely or partially. In the illustrated embodiment, overall widths of the secondary scraping parts 1204 are the same, and the present application is not limited thereto. In another embodiment, the secondary scraping part 1204 gradually becomes smaller in a direction toward the floor, so as to prevent the secondary scraping part 1204 from being lifted away from the floor surface due to upwarping during sundries scraping. In this way, the debris may be removed thoroughly, a friction force with the floor may be reduced, a driving force of the smart cleaning device for driving the side brush 100 to rotate may be reduced, and smooth movement of the smart cleaning device may be effectively ensured while saving power. In another embodiment, one scraper 123 may include a plurality of rear scrapers 123*b*; that is, one scraper may include a plurality of secondary scraping parts 1204.

With combined reference to FIG. 1 and FIG. 5, in the illustrated embodiments the secondary scraping part 1204 is disposed vertically relative to the floor. In the rotational direction of the side brush 100, the scraping part 1203 includes a front-end face P1 and a rear-end face P3 that are disposed from front to back. The scraping part 1203 is inclined as a whole in the circumferential direction D2 relative to the rotational direction of the connecting part 1202 toward the side brush 100, so that the front-end face P1 of the scraping part 1203 away from the secondary scraping part 1204 may be formed as a bevel that is inclined outward in the circumferential direction D2 relative to the connecting part 1202, and a lower end (free end) of the front-end face P1 is further forward than an upper end of the front-end face P1. Therefore, during cleaning, the scraping part 1203 may scrape the debris more easily, especially the debris at an included angle of walls (the included angle between the floor and the wall), or the debris at an included angle between another object and the floor. The secondary scraping part 1204 may extend in the axial direction D3, so that the second surface P2 of the secondary scraping part 1204 facing the scraping part 1203 may be formed as an axial surface that extends in the axial direction D3. That is, when the side brush 100 is horizontally mounted, the second surface P2 of the secondary scraping part 1204 facing the scraping part 1203 is a plane that extends vertically. The scraping part 1203 further includes a tip 12031 that is located at the free end of the scraping part 1203 and that extends in the movement direction, so that the sundries can be scraped thoroughly.

In the illustrated embodiments, the scraping part 1203 is disposed as a whole in an inclined manner relative to the floor surface, so that in the rotational direction of the side brush 100, the front-end face P1 is disposed in an inclined manner relative to the floor, and the present application is not limited thereto. In another embodiment, only the front-end face P1 is disposed in an inclined manner relative to the floor, and a lower end (free end) of the front-end face P1 is further forward than an upper end of the front-end face P1.

As shown in FIG. 3 and FIG. 5, the side brush may include a plurality of scrapers 123, and the scrapers 123 are configured to move in a rotational manner to scrape debris. As shown in FIG. 3, the side brush includes five scrapers 123, and the five scrapers 123 are evenly distributed along a circumference of the side brush base 110. Each scraper 123 includes one scraping part 1203 and one secondary scraping part 1204. In other embodiments, each scraper 123 may include a plurality of secondary scraping parts 1204. The present application is not limited thereto. In another embodiment, all the scraping parts 1203 and secondary scraping parts 1204 may be in the same shape or different shapes, or some of them can be in different shapes. The quantity of the scrapers 123 is not limited in the present application, and may be set depending on actual needs.

In an embodiment not shown, if desired and/or expected, the scraping part 1203 may extend in the axial direction D3, and the front-end face P1 is an axial surface in the axial direction D3. The secondary scraping part 1204 may be slightly inclined toward the scraping part 1203, and the second surface P2 is a bevel that is slightly inclined toward the scraping part 1203, so that the secondary scraping part 1204 can scrape the debris more easily.

It can be understood that the directional term "outward in a circumferential direction D2" used herein to describe the front scraper 123*a* refers to a direction of the front scraper 123*a* away from the rear scraper 123*b* in the circumferential direction D2.

As shown in FIG. 5, optionally, a thickness of the scraping part 1203 is greater than a thickness of the secondary scraping part 1204. It can be understood that the scraper in the present application is a platelike part, and the thickness of the scraping part 1203 refers to a size in the circumferential direction D2. That is, the size L1 of the scraping part 1203 in the circumferential direction D2 is greater than the size L2 of the secondary scraping part 1204 in the circumferential direction D2.

Figure 6:
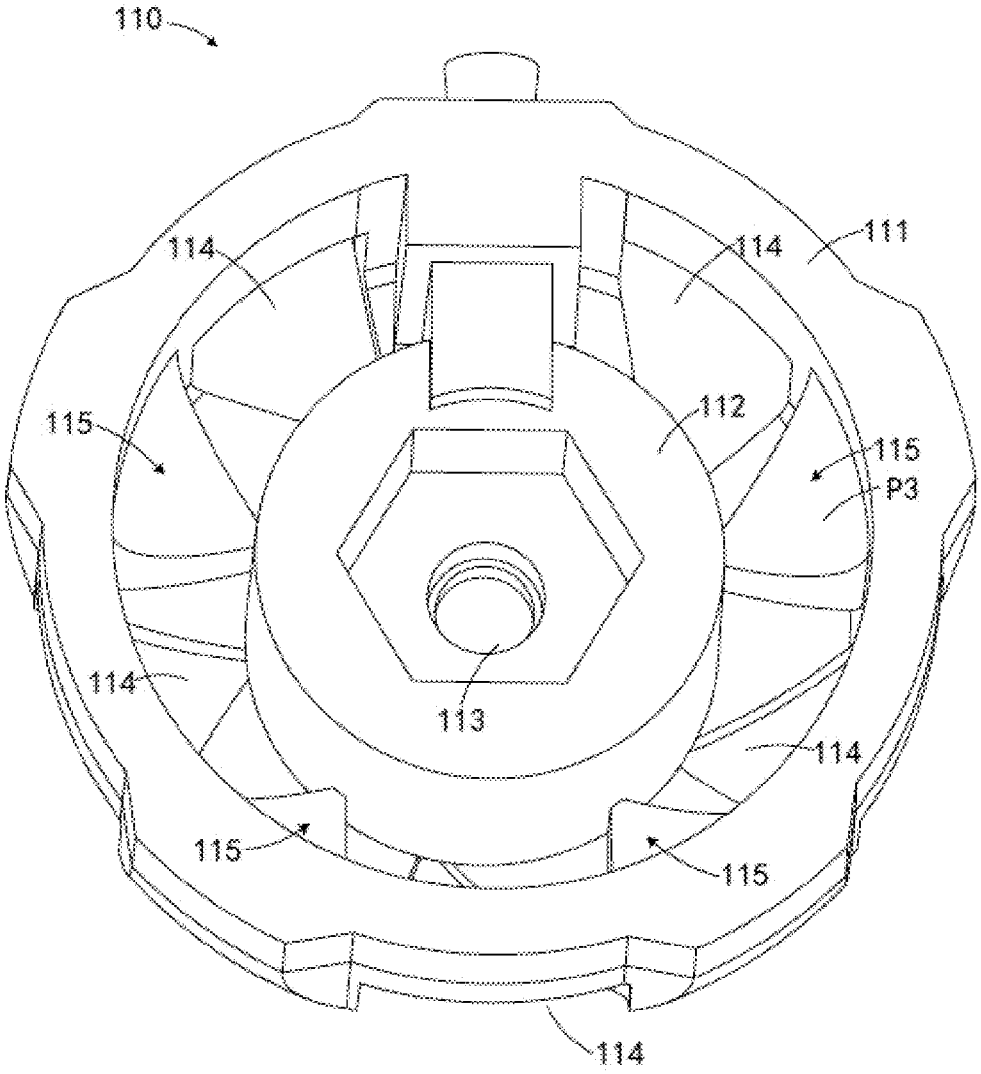
FIG. 6 is a schematic three-dimensional diagram of a side brush base shown in FIG. 1.
Figure 7:
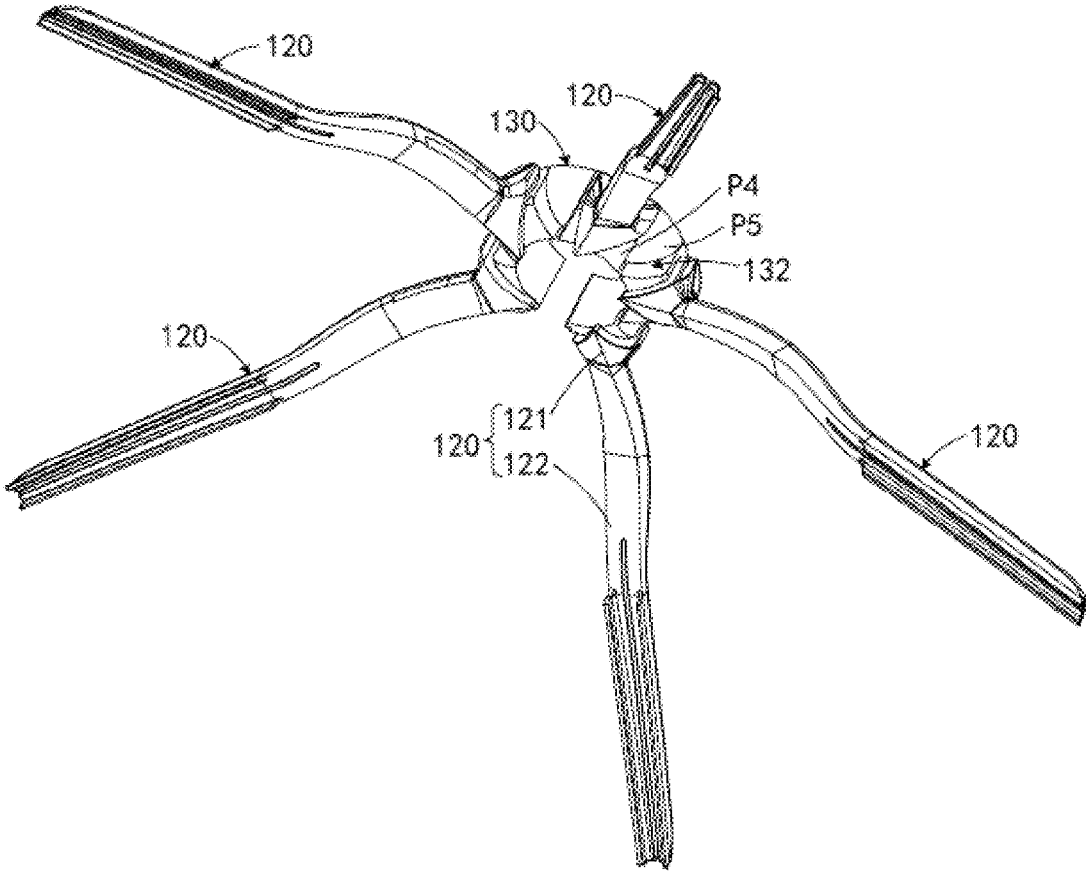
FIG. 7 is a schematic three-dimensional diagram of a brush body and a brush body base shown in FIG. 1.

Further, as shown in FIG. 6 and FIG. 7, the side brush base 110 is a separate member. The side brush base 110 includes a side brush base body 111 and a boss 112 for mounting a rotation shaft. The side brush base body 111 is provided with a receiving part whose opening 114 faces upward. The boss 112 is located at the center of the side brush base body 111 and extends upward from the bottom of the receiving part. The brush body base 130 is accommodated in the receiving part, and is located between the boss 112 and the side brush base body 111 (refer to FIG. 1). The shape of the brush body base 130 adapts to the shape of the side brush base body 111. Specifically, the side brush base body 111 is an approximate semisphere that has a receiving part, the brush body base 130 is an approximate ring (refer to FIG. 3), and the boss 112 may be accommodated in a center hole 131 of the brush body base 130. In the illustrated embodiments, the center of the boss 112 may be provided with a mounting hole 113 for mounting the rotation shaft. The mounting hole 113 is coaxial with the center hole 131 of the brush body base 130.

The side brush base body 111 is provided with a side brush base opening 114 that corresponds to the brush body mounting part 121, and the brush body 120 penetrates the side brush base opening 114 and extends outward in the radial direction D1 (refer to FIG. 2). The shape of the brush body mounting part 121 adapts to the side brush base opening 114. Specifically, a protrusion 115 for abutting against the brush body base 130 is disposed between adjacent side brush base openings 114, and the protrusion 115 extends upward from the side brush base body 111. An upper surface P3 of the protrusion 115 is formed as an arc-shaped surface. The brush body base 130 is provided with a recess 132 that corresponds to the protrusion 115. The recess 132 is recessed upward from a bottom surface P4 of the brush body base 130 and includes a side opening. The protrusion 115 can be confined to the recess 132. An upper surface P5 of the recess 132 is formed as an arc-shaped surface that corresponds to and abuts against the upper surface P3 of the protrusion 115.

Unless otherwise defined, the technical and scientific terms used in this specification have the same meanings as those commonly understood by a person skilled in the art of this application. The terms used in this specification are merely used for the purpose of describing specific implementations and are not intended to limit this application. Terms such as "member" and "part" that appear in this specification can represent either a single part or a combination of a plurality of parts. Terms such as "mount" and "dispose" that appear in this specification may indicate that one part is attached directly to another part, or may indicate that one part is attached to another part by using an intermediate part. In this specification, a feature described in one embodiment can be applied to another embodiment individually or in combination with other features, unless the feature is not applicable or otherwise stated in another embodiment.

This application has been described by using the foregoing embodiments, but it should be understood that the foregoing embodiments are used only for the purposes of illustration and description, and are not intended to limit this application to the scope of the described embodiments. In addition, a person skilled in the art can understand that this application is not limited to the foregoing embodiments, and further variations and modifications can be made according to the teachings of this application. These variations and modifications fall within the protection scope of this application. The protection scope of this application shall be subject to the appended claims and their equivalent range.

| Description of reference numerals: | |
|---|---|
| 100: | side brush |
| 110: | side brush base |
| 111: | side brush base body |
| 112: | boss |
| 113: | mounting hole |
| 114: | side brush base opening |
| 115: | protrusion |
| 120: | brush body |
| 121: | brush body mounting part |
| 122: | brush body extension part |
| 123: | scraper |
| 123a: | front scraper |
| 123b: | rear scraper |
| 124: | opening |
| 130: | brush body base |
| 131: | center hole |
| 132: | recess |
| 1202: | connecting part |
| 1203: | scraping part |
| 1204: | scraping part |
| 12031: | tip |

What is claimed is:

1. A side brush, comprising:

a side brush base, configured to be mounted to a smart cleaning device; and one or more scrapers, connected to a peripheral side of the side brush base and configured to engage a floor surface to remove debris, wherein each scraper comprises a connecting part connected to the side brush base, and a scraping part connected to a first portion of the connecting part and configured to extend from the first portion of the connecting part to the floor surface;

wherein each scraper is configured to rotate about an axis to remove the debris, where the axis is configured to be generally perpendicular to the floor surface;

wherein the scraping part comprises a front surface and a rear surface in a rotational direction of the scraper, and the front surface is configured to tilt at an angle relative to the floor surface;

wherein the front surface comprises a first end configured to make contact with the floor surface and a second end connected to the connecting part, where the first end precedes the second end in the rotational direction of the scraper;

wherein each scraper further comprises a secondary scraping part connected to a second portion of the connecting part and configured to extend from the second portion of the connecting part to the floor surface, where the secondary scraping part is configured to be disposed vertically relative to the floor surface, and wherein the second portion of the connecting part is parallel to the first portion of the connecting part.

2. The side brush of claim 1, wherein the scraping part precedes the secondary scraping part in the rotational direction of the scraper.

3. The side brush of claim 1, wherein an opening is provided between the first portion of the connecting part and the second portion of the connecting part.

4. The side brush of claim 1, wherein the side brush comprises a plurality of scrapers, and the plurality of scrapers are evenly distributed along a circumference of the side brush base.

5. The side brush of claim 1, wherein each scraper is formed through glue injection molding.

6. A smart cleaning device, comprising:

a device body;

a driving system connected to the device body and configured to drive the smart cleaning device across a floor surface;

a cleaning system configured to perform a cleaning operation, wherein:

the cleaning system comprises a side brush comprising:

a side brush base mounted to a bottom of the device body, and one or more scrapers connected to a peripheral side of the side brush base and configured to engage the floor surface to remove debris, wherein each scraper comprises a connecting part connected to the side brush base, and a scraping part connected to a first portion of the connecting part and configured to extend from the first portion of the connecting part to the floor surface;

wherein each scraper is configured to rotate about an axis to remove the debris, where the axis is configured to be generally perpendicular to the floor surface;

wherein the scraping part comprises a front surface and a rear surface in a rotational direction of the scraper, and the front surface is configured to tilt at an angle relative to the floor surface;

wherein the front surface comprises a first end configured to make contact with the floor surface and a second end connected to the connecting part, where the first end precedes the second end in the rotational direction of the scraper;

wherein each scraper further comprises a secondary scraping part connected to a second portion of the connecting part and configured to extend from the second portion of the connecting part to the floor surface, where the secondary scraping part is configured to be disposed vertically relative to the floor surface, and wherein the second portion of the connecting part is parallel to the first portion of the connecting part.

7. The smart cleaning device of claim 6, wherein the side brush comprises a brush body base connected to the one or more scrapers and assembled to the side brush base.

8. The smart cleaning device of claim 7, wherein the side brush base comprises a side brush base body, a boss to be assembled to the device body, and a receiving part between the side brush base body and the boss, where the brush body base is accommodated in the receiving part.

9. The smart cleaning device of claim 8, wherein the side brush base body comprises one or more side brush base openings, each side brush base opening is configured to be penetrated by a respective scraper, and each scraper comprises a brush body mounting part adapted in shape to a respective side brush base opening.

10. The smart cleaning device of claim 6, wherein the scraping part precedes the secondary scraping part in the rotational direction of the scraper.

11. The side brush of claim 1, wherein the side brush comprises a brush body mounting part connected to the side brush base, and the connecting part of each scraper is connected to the side brush base through the brush body mounting part.

12. The side brush of claim 11, wherein the connecting part of each scraper is integrally formed with the brush body mounting part.

13. The smart cleaning device of claim 6, wherein the side brush comprises a brush body mounting part connected to the side brush base, and the connecting part of each scraper is connected to the side brush base through the brush body mounting part.

14. The smart cleaning device of claim 13, wherein the connecting part of each scraper is integrally formed with the brush body mounting part.

* * * * *